US010704234B2

(12) United States Patent
Baer et al.

(10) Patent No.: US 10,704,234 B2
(45) Date of Patent: Jul. 7, 2020

(54) PRECIPITATION RECLAMATION STORAGE SYSTEM FOR USE IN A STRUCTURE

(71) Applicant: WHIRLPOOL CORPORATION, Benton Harbor, MI (US)

(72) Inventors: Robert R. Baer, St. Joseph, MI (US); Andria Bauman, Stevensville, MI (US); Jason Schneemann, St. Joseph, MI (US); Ronald L. Voglewede, St. Joseph, MI (US); Elizabeth Bourgeois, Baroda, MI (US); Eric J. Bowler, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 28 days.

(21) Appl. No.: 16/213,087

(22) Filed: Dec. 7, 2018

(65) Prior Publication Data

US 2020/0181889 A1 Jun. 11, 2020

(51) Int. Cl.
*E03B 1/04* (2006.01)
*E04D 13/08* (2006.01)

(52) U.S. Cl.
CPC ..... *E03B 1/041* (2013.01); *E03B 2001/047* (2013.01); *E04D 2013/0826* (2013.01); *Y10T 137/698* (2015.04); *Y10T 137/6969* (2015.04)

(58) Field of Classification Search
CPC ..... E03B 1/041; E03B 2001/047; Y10T 137/6969; Y10T 137/698; E04D 2013/0826
See application file for complete search history.

(56) References Cited

U.S. PATENT DOCUMENTS 1,453,109 A * 4/1923 Hathaway ..... E03B 1/04 137/357
5,711,091 A * 1/1998 Bos ..... D06F 58/20 34/140
5,916,023 A * 6/1999 Meyer ..... D06F 58/14 34/235
6,436,283 B1 8/2002 Duke
(Continued)

FOREIGN PATENT DOCUMENTS

DE 19751590 C1 * 4/1999
FR 2911617 A1 * 7/2008

OTHER PUBLICATIONS

Machine translation FR 2911617.*
Machine translation DE 19751590.*

*Primary Examiner* — Kevin F Murphy
(74) *Attorney, Agent, or Firm* — Price Heneveld LLP

(57) ABSTRACT

A precipitation reclamation system includes a downspout adapter configured to receive runoff precipitation from a precipitation channel for a structure. The downspout adapter is configured to attach to the structure at a vent that places an interior of the structure in communication with an area external to the structure. A reclamation chamber is disposed within an appliance housing. The reclamation chamber has a pump. A reclamation conduit extends from the downspout adapter to the reclamation chamber and is configured to direct the precipitation to the reclamation chamber to define reclaimed water. The pump is adapted to deliver the reclaimed water from the reclamation chamber to a portion of the structure for use.

20 Claims, 11 Drawing Sheets

(56) References Cited

U.S. PATENT DOCUMENTS

| | | | | |
|---|---|---|---|---|
| 6,553,723 | B1 | 4/2003 | Alcorn | |
| 6,889,395 | B1 * | 5/2005 | Hodges | E03B 1/04 4/665 |
| 6,941,702 | B1 * | 9/2005 | Abrams | E03B 1/041 52/16 |
| 7,025,076 | B2 | 4/2006 | Zimmerman, Jr. et al. | |
| 7,080,662 | B1 * | 7/2006 | Pratt | E03B 1/04 137/565.34 |
| 7,779,855 | B2 | 8/2010 | McAvoy et al. | |
| 7,870,868 | B1 * | 1/2011 | Ilalaole | E03D 5/003 137/434 |
| 7,971,602 | B2 | 7/2011 | Lewis | |
| 8,097,151 | B2 | 1/2012 | Allan | |
| 8,438,788 | B2 | 5/2013 | Bell et al. | |
| 9,897,332 | B2 | 2/2018 | Glover et al. | |
| 2008/0128030 | A1 | 6/2008 | Lewis | |
| 2008/0132160 | A1 * | 6/2008 | Han | D06F 58/30 454/344 |
| 2008/0175668 | A1 | 7/2008 | Haese | |
| 2011/0017301 | A1 | 1/2011 | Canavan | |
| 2011/0050395 | A1 | 3/2011 | Ervin | |
| 2012/0318475 | A1 | 12/2012 | Glover | |
| 2014/0346099 | A1 | 11/2014 | Brantley et al. | |
| 2018/0163976 | A1 | 6/2018 | Glover et al. | |

* cited by examiner

PRECIPITATION RECLAMATION STORAGE SYSTEM FOR USE IN A STRUCTURE

FIELD OF THE DEVICE

The device is in the field of precipitation reclamation systems, and more specifically, a precipitation reclamation system that captures water from a gutter system and delivers the water into a structure for storage within or near a household appliance for reuse.

SUMMARY

In at least one aspect, a precipitation reclamation system includes a downspout adapter configured to receive runoff precipitation from a precipitation channel for a structure. The downspout adapter is configured to attach to the structure at a vent that places an interior of the structure in communication with an area external to the structure. A reclamation chamber is disposed within an appliance housing. The reclamation chamber has a pump. A reclamation conduit extends from the downspout adapter to the reclamation chamber and is configured to direct the precipitation to the reclamation chamber to define reclaimed water. The pump is adapted to deliver the reclaimed water from the reclamation chamber to a portion of the structure for use.

In at least another aspect, a dryer vent adapter includes an inlet that is configured for attachment to a precipitation downspout of a structure. An outlet is configured for attachment with an interior fluid conduit positioned within the structure. A body is configured for placement within a dryer vent housing. The body defines an inner aperture through which a dryer vent is to be received. The body is configured to be positioned around the dryer vent and within the dryer vent housing.

In at least another aspect, a method of reclaiming runoff precipitation from an exterior of a structure for reuse within the structure includes diverting runoff precipitation from a precipitation downspout and into a dryer vent adapter. The runoff precipitation is delivered from the dryer vent adapter and to a reclamation chamber via a dryer vent housing that receives the dryer vent adapter and a reclamation conduit that extends between the dryer vent adapter and the reclamation chamber. The runoff precipitation is stored within the reclamation chamber at least partially positioned proximate an appliance housing to define reclaimed water. The reclamation conduit runs from the dryer vent adapter to the reclamation chamber. The reclaimed water is pumped from the reclamation chamber to a fluid outlet of the structure.

These and other features, advantages, and objects of the present device will be further understood and appreciated by those skilled in the art upon studying the following specification, claims, and appended drawings.

DETAILED DESCRIPTION OF EMBODIMENTS

Figure 1:
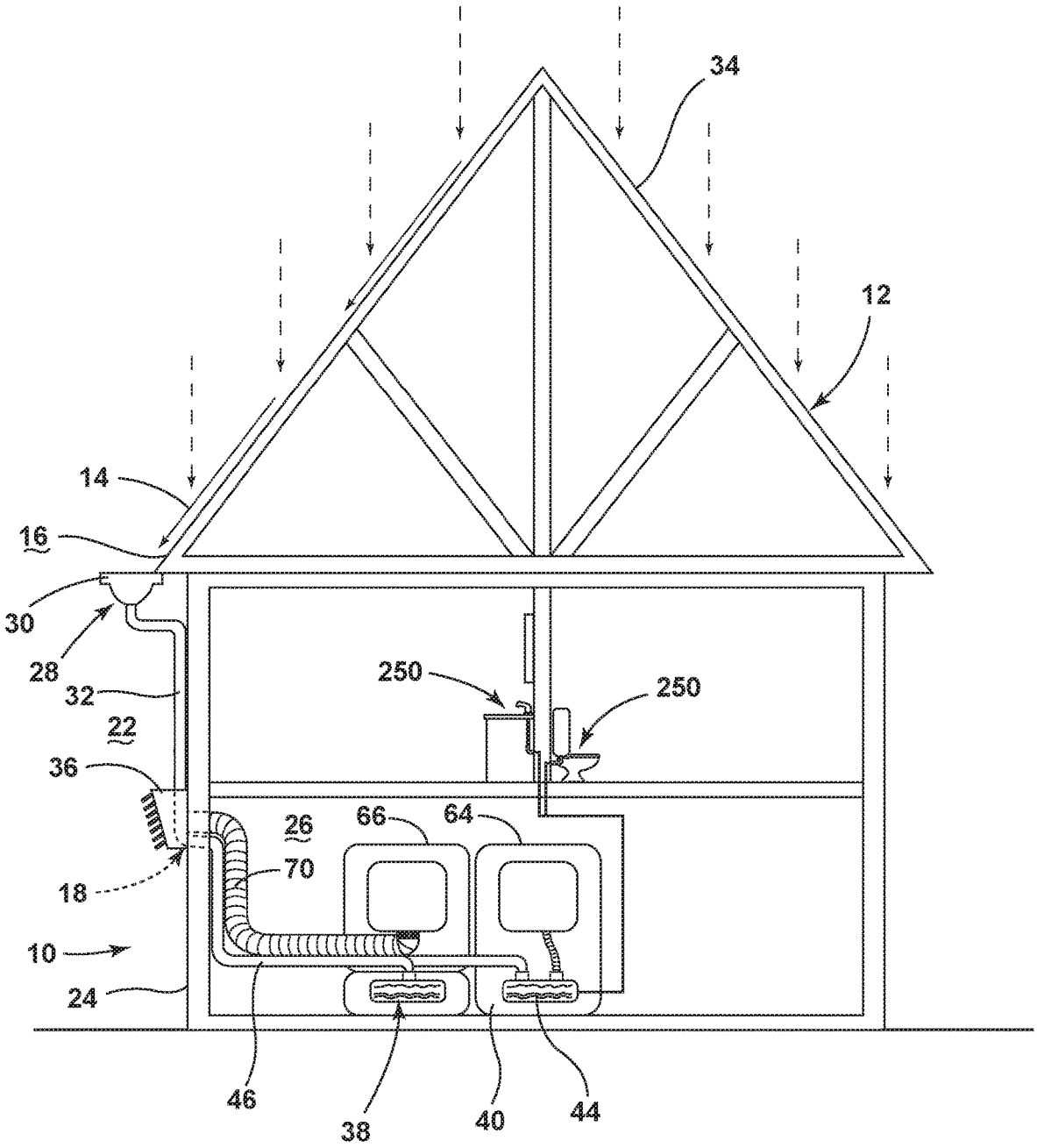
FIG. 1 is a schematic cross-sectional view of a structure incorporating an aspect of the precipitation reclamation system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 10:
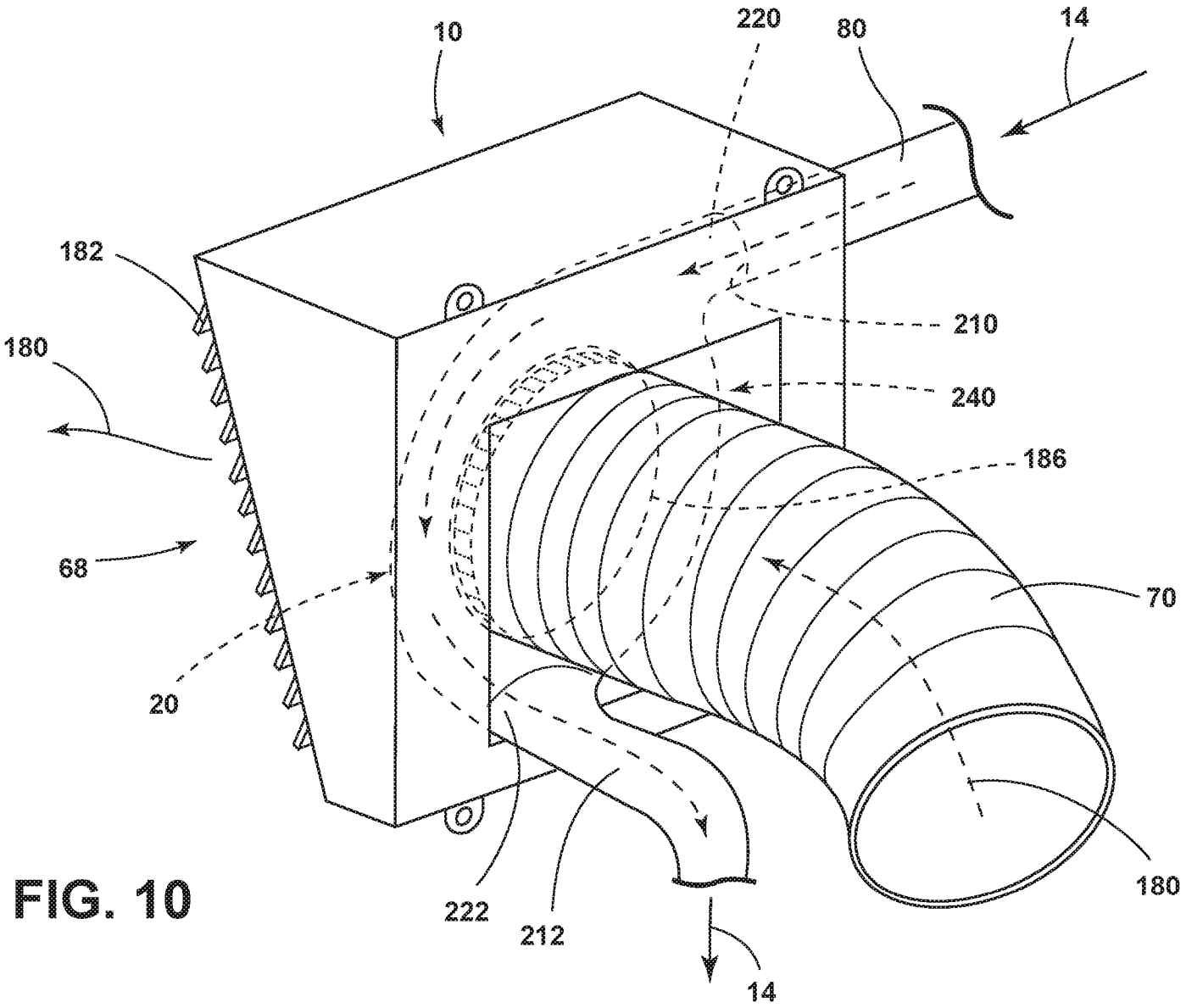
FIG. 10 is a front perspective view of an aspect of a downspout adapter that connects between a gutter system of a structure and the reclamation chamber for delivering water through a dryer vent housing.

With respect to FIGS. 1-6, reference numeral 10 generally refers to a precipitation reclamation system that is incorporated within a structure 12 for harvesting, treating, storing and reusing reclaimed rainwater within that structure 12. The precipitation reclamation system 10 receives runoff precipitation 14 from various exterior surfaces 16 of the structure 12 and directs at least a portion of this runoff precipitation 14 through an adapter, typically in the form of a downspout adapter 18 or dryer vent adapter 20 (shown in FIG. 10), that transfers the runoff precipitation 14 from an exterior 22 of the structure 12, through an opening within the building envelope 24 and to an interior space 26 of the structure 12 for reuse. According to various aspects of the device, the precipitation reclamation system 10 includes a downspout adapter 18 that is configured to receive runoff precipitation 14 from a precipitation channel 28 for a structure 12. Typically, the precipitation channel 28 is in the form of a gutter 30, downspout 32, or other conduit for moving precipitation away from a roof 34 of the structure 12. The downspout adapter 18 is configured to attach to the structure 12 at an opening in the building envelope 24 that places the interior of the structure 12 in communication with an area external to the structure 12, typically a dryer vent housing 36. A reclamation chamber 38 is disposed within an appliance housing 40 or near an appliance housing 40. The reclamation chamber 38 also includes a pump 42 for moving reclaimed water 44 from this reclamation chamber 38 and to another portion of the structure 12 for reuse. A reclamation conduit 46 extends from the downspout adapter 18 and extends to the reclamation chamber 38. The reclamation conduit 46 is configured to direct the runoff precipitation 14 to the reclamation chamber 38 to define reclaimed water 44 that is then stored within the reclamation chamber 38. The pump 42 is adapted to deliver this reclaimed water 44 from the reclamation chamber 38 to another portion of the structure 12 for use, such as within an appliance 62, lavatory, toilet or other similar household use. The precipitation reclaimed by the precipitation reclamation system 10 can include rainwater, snow, dew, hail, snow melt, and other liquid and frozen forms of precipitation.

According to various aspects of the device, the appliance housing 40 can be in the form of a pedestal 60 that is typically positioned under, or adjacent to, at least one appliance 62, and typically a laundry appliance 62. It is contemplated that the at least one laundry appliance 62 is positioned on top of the pedestal 60, such as in the case of a laundry washer 64 and laundry dryer 66. As exemplified in FIG. 4, this pedestal 60 can extend continuously under each of the washer 64 and dryer 66 so that a single elongated pedestal 60 is provided to act as the reclamation chamber 38.

Referring again to FIGS. 1-3, the precipitation reclamation system 10 can include a rainwater harvesting system 68 that extends from a vent within the building envelope 24, typically a dryer vent 70 and dryer vent housing 36, and includes the reclamation conduit 46 for moving this runoff precipitation 14 to a fluid treatment mechanism 100 and then to the reclamation chamber 38 for storage until the reclaimed water 44 is needed for reuse.

Referring again to FIGS. 1 and 2, in order to harvest the runoff precipitation 14, the downspout adapter 18 is configured to be in communication with the downspout 32 or gutter 30 of the gutter system for the structure 12. A bypass channel 80 (show in FIG. 10) can extend from the gutter 30 or the downspout 32 and proceed to allow for transport of the runoff precipitation 14 to the downspout adapter 18. It is contemplated that only a portion of the runoff precipitation 14 will be delivered to the downspout adapter 18 during a precipitation event. Many gallons of water may fall onto the structure 12 within a short period of time. Only a small portion of this runoff precipitation 14 may be able to be reused within the precipitation reclamation system 10. In order to prevent an overflow of the reclamation chamber 38, the downspout adapter 18 or the bypass channel 80 can include a shutoff valve or other regulating mechanism 82 that can prevent an excessive flow of runoff precipitation 14 from entering into the downspout adapter 18 and through the building envelope 24. This regulating mechanism 82 can be in communication with various aspects of the precipitation reclamation system 10.

Referring now to FIGS. 1-6, typically, the reclamation chamber 38 will include a float 86, or other sensing mechanism or switch 84 that can determine the amount of reclaimed water 44 stored within the reclamation chamber 38. When the amount of reclaimed water 44 within the reclamation chamber 38 reaches a predetermined amount, a switch 84 within the reclamation chamber 38 can communicate with the regulating mechanism 82 to stop further flow of the runoff precipitation 14 into the bypass channel 80 and through the downspout adapter 18.

Referring again to FIGS. 1-3, the precipitation reclamation system 10 can include a fluid treatment mechanism 100 for removing particulate and other various contaminants from this runoff precipitation 14. This unwanted material can be in the form of granular material from roof shingles, organic material that may be on the roof shingles or within a portion of the gutter system for the structure 12, various microbial contaminants that may be present within the runoff precipitation 14 or various other materials that may be accumulated within the runoff precipitation 14 as it moves toward the downspout adapter 18. In order to remove these contaminants from the runoff precipitation 14, the fluid treatment mechanism 100 can include at least a particulate filter 102 for removing particulate matter from the runoff precipitation 14. In a system where only the particulate filter 102 is included within the water treatment mechanism, such reclaimed water 44 is typically not potable and not safe for drinking or other human interaction. Accordingly, such reclaimed water 44 may be used for waste water such as within toilets, sprinkler systems, various disposals and compactors, and other waste-type uses for the reclaimed water 44.

Figure 2:
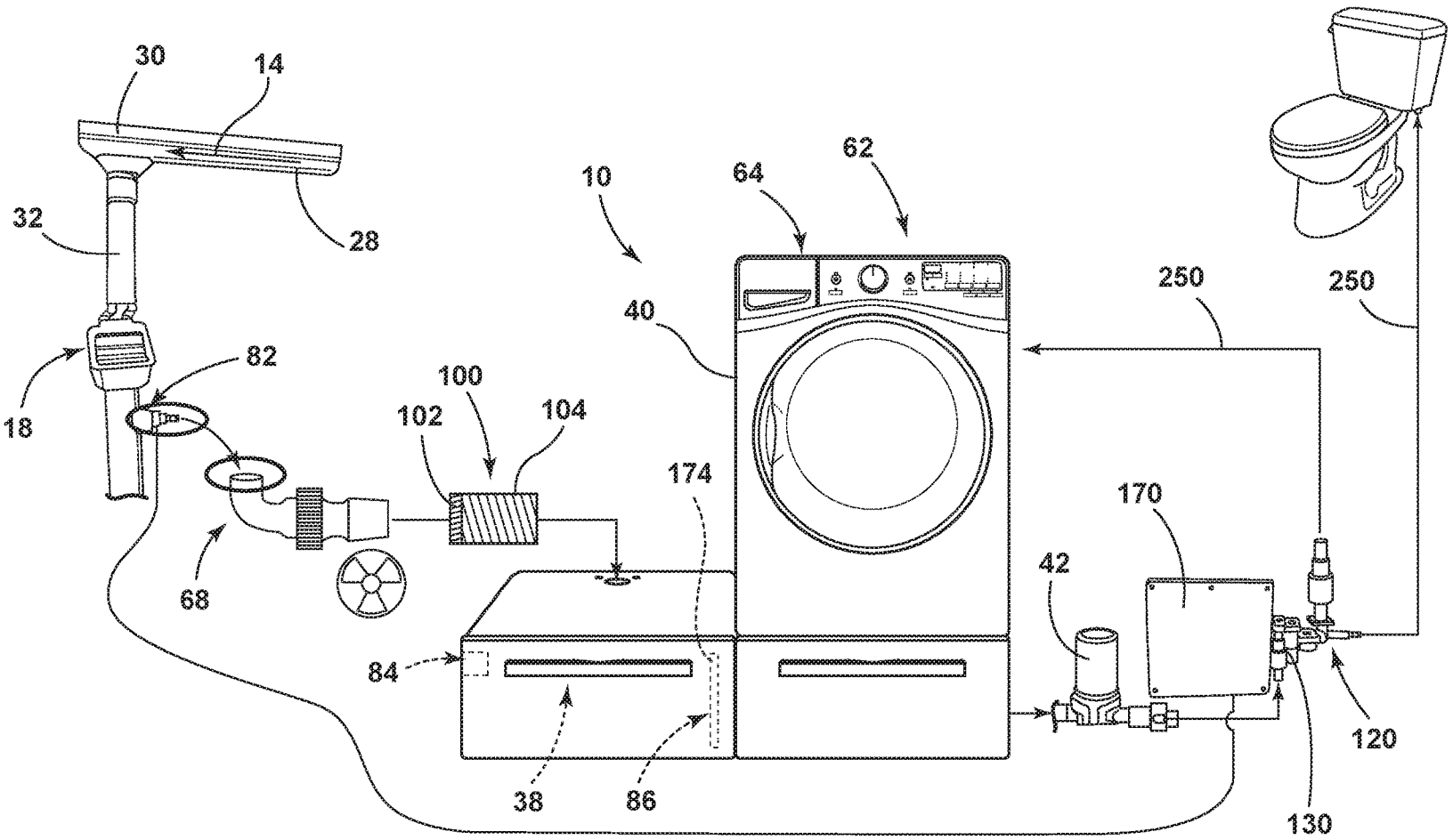
FIG. 2 is a schematic view of an aspect of the precipitation reclamation system incorporating various components that are operated in connection with a household appliance.
Figure 3:
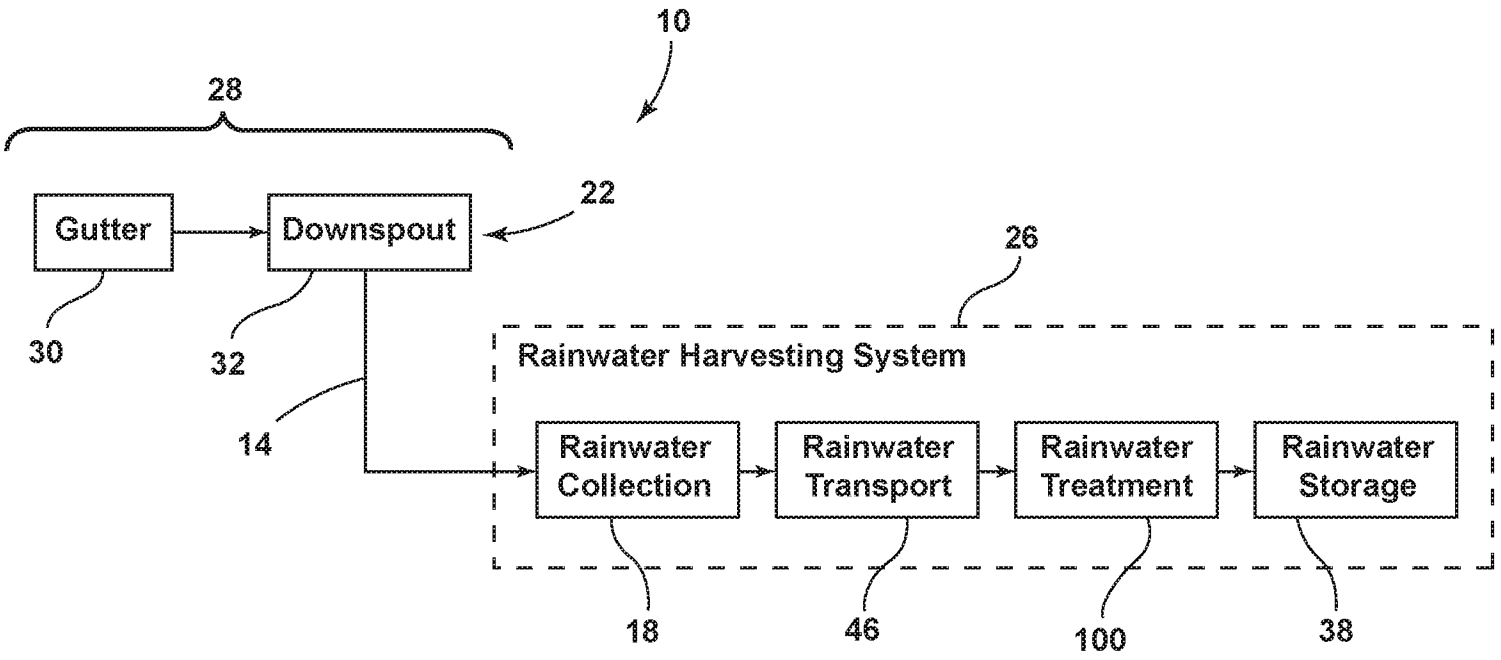
FIG. 3 is a schematic flow diagram illustrating functions performed within the precipitation reclamation system.
Figure 4:
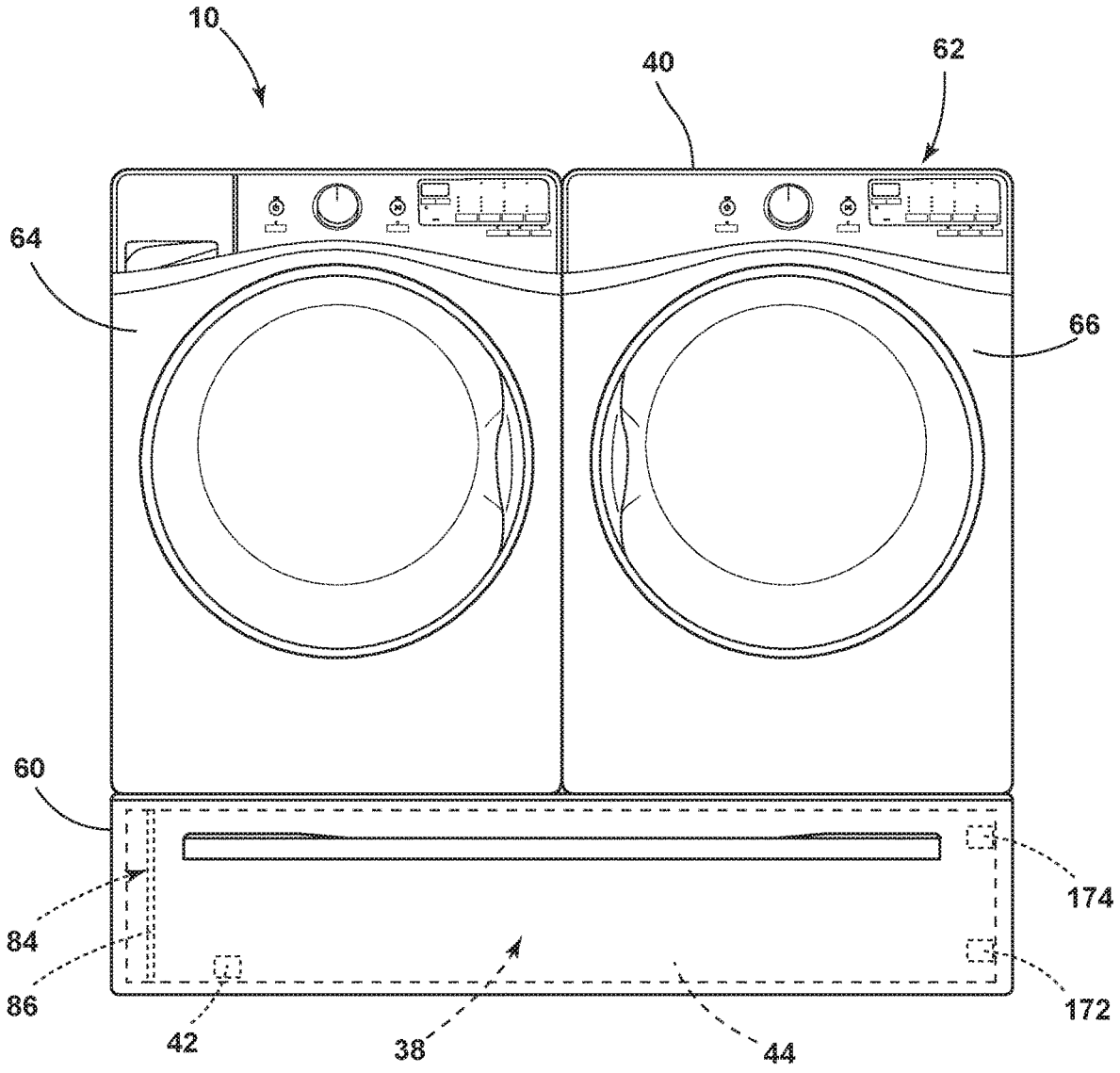
FIG. 4 is a front elevational view of a laundry appliance pair that is positioned over a pedestal that incorporates a reclamation chamber for storing reclaimed precipitation.
Figure 5:
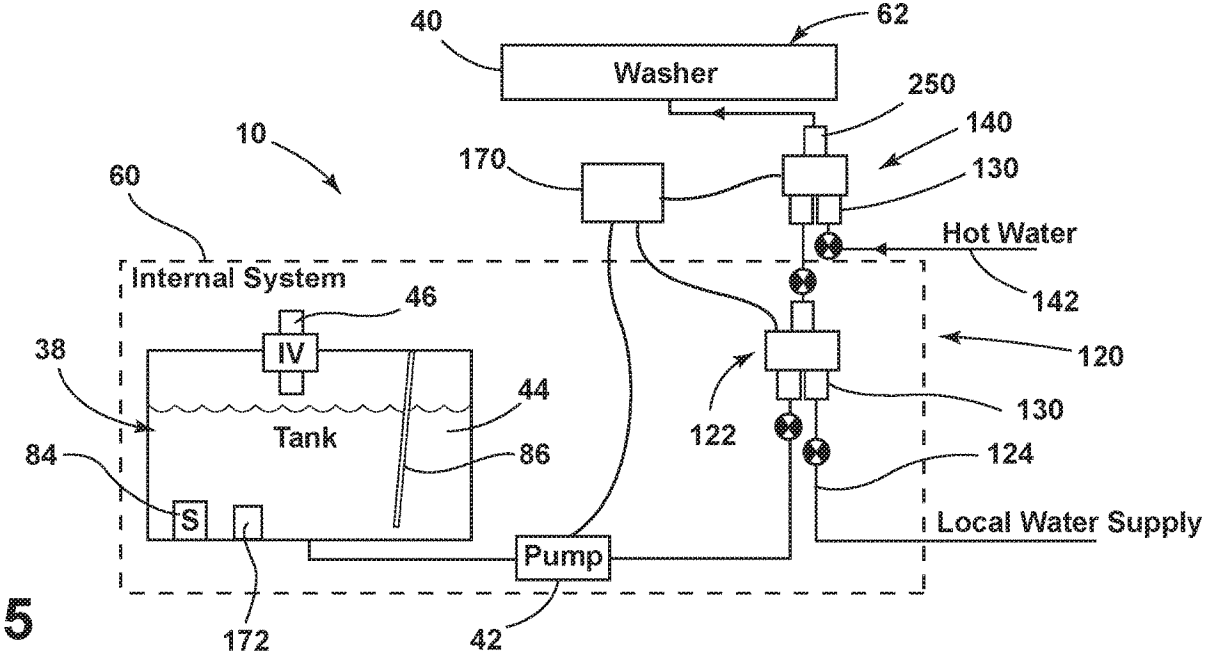
FIG. 5 is a schematic view of an aspect of a pump that operates in connection with the reclamation chamber for delivering reclaimed precipitation throughout a structure.
Figure 6:
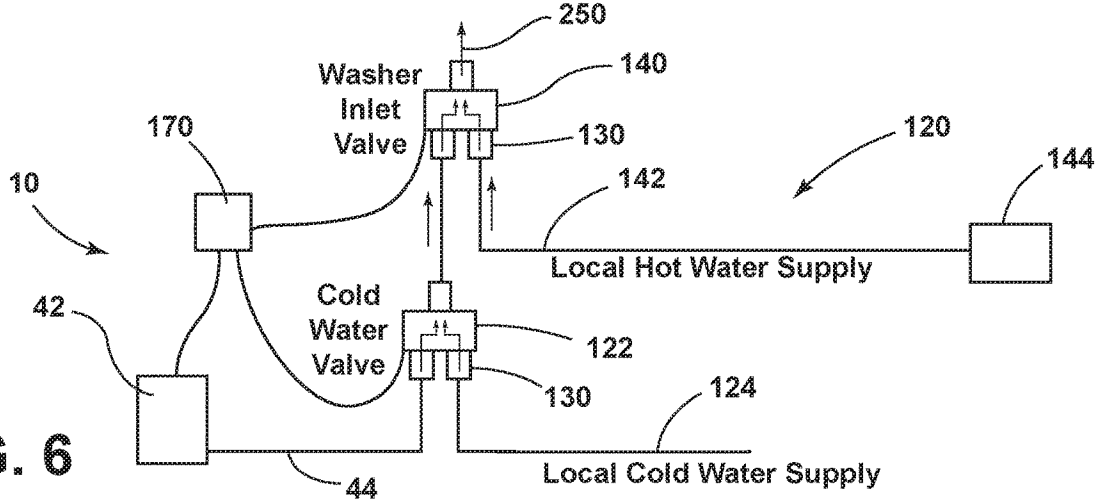
FIG. 6 is a schematic view of a valve assembly operated in connection with a pump of FIG. 5.
Figure 7:
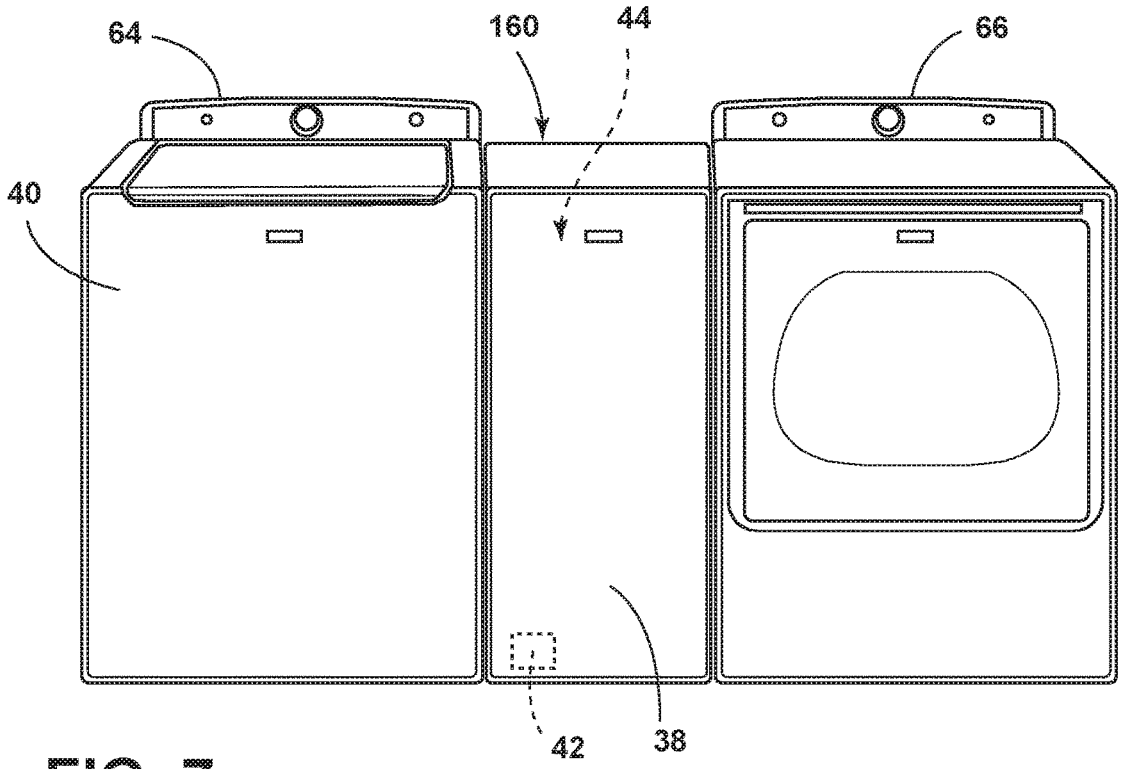
FIG. 7 is a front perspective view of an aspect of a reclamation chamber incorporated within a pair of laundry appliances.
Figure 8:
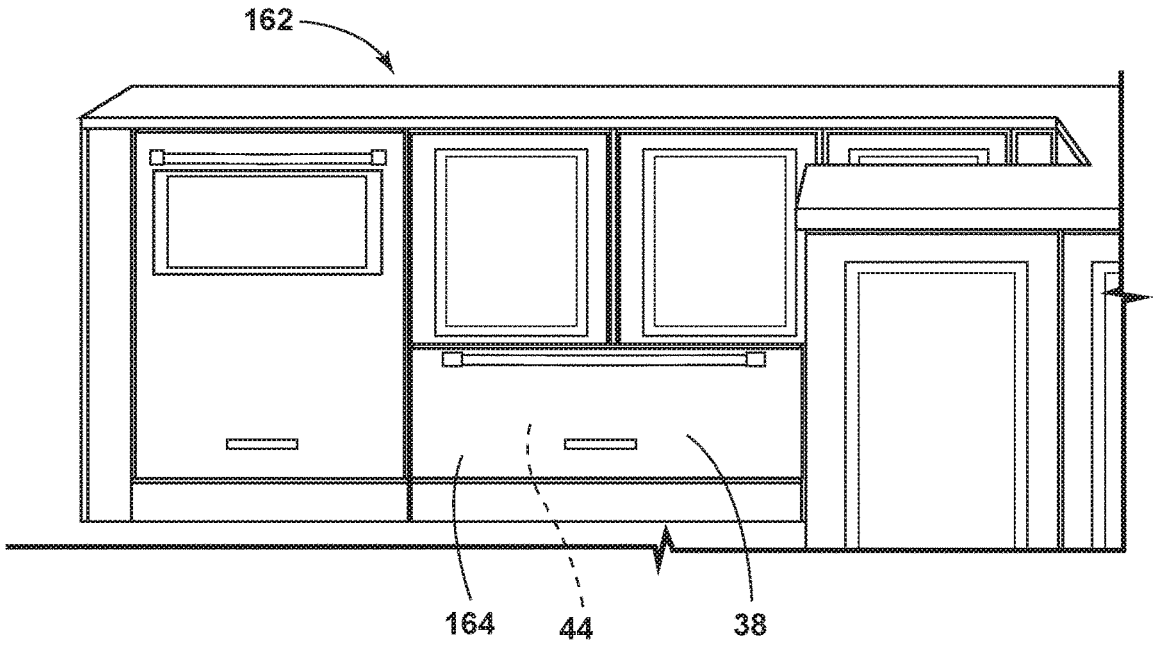
FIG. 8 is a front perspective view of a section of cabinetry that incorporates an aspect of the reclamation chamber for storing reclaimed precipitation.
Figure 9:
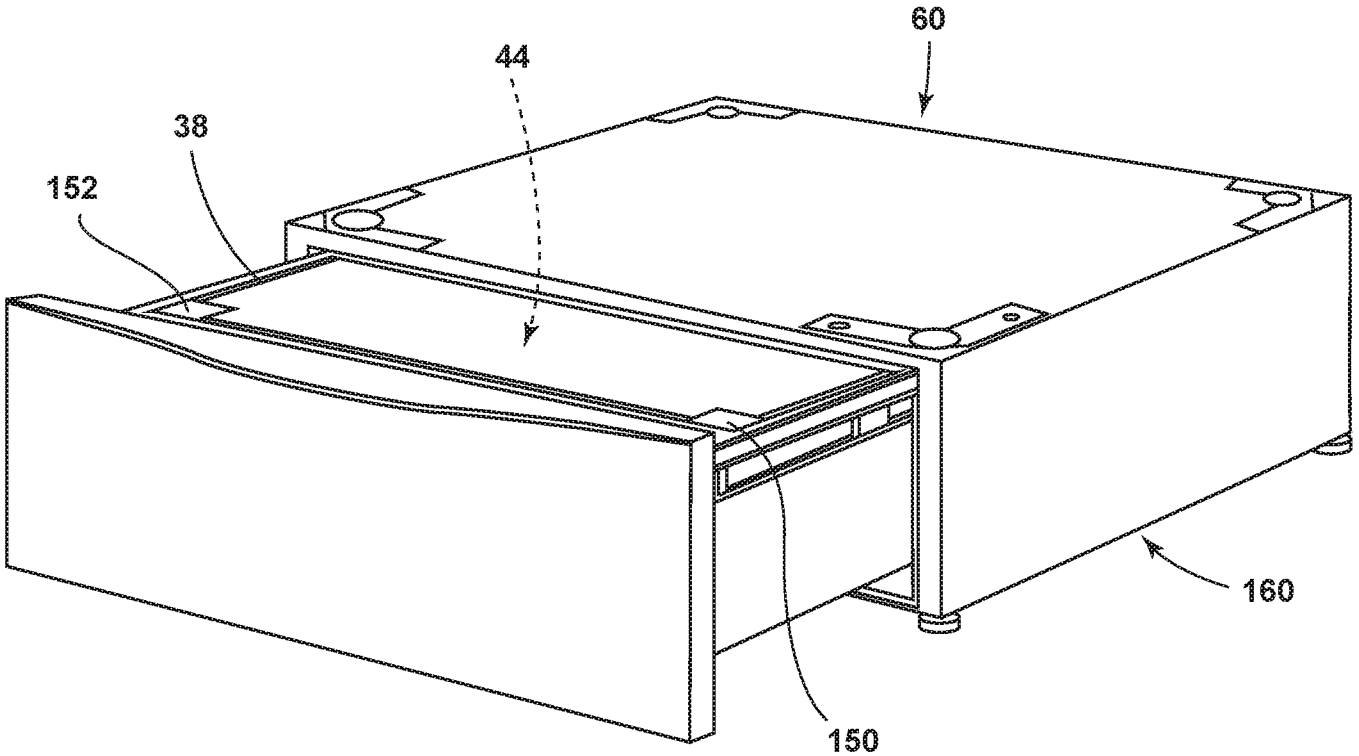
FIG. 9 is a top perspective view of an aspect of the pedestal of FIG. 4 shown with a drawer member in an open position.

In various aspects of the device, as exemplified in FIGS. 1-3, the fluid treatment mechanism 100 can also include a microbe treatment mechanism 104 for removing, killing, or otherwise eliminating various microbial contaminants within the runoff precipitation 14. Such microbe treatment mechanisms 104 can include reverse osmosis filters, ultraviolet light filters, various other filters including disinfecting materials, such as copper and titanium dioxide, other chemical treatments, activated carbon and other similar treatment mechanisms that may be useful in removing at least a portion of a microbial population within runoff precipitation 14. Depending upon the type of microbe treatment mechanism 104 used within the precipitation reclamation system 10, the resulting reclaimed water 44 may or may not be potable. Potable water (water that is safe for human consumption) requires a higher degree of sanitation to prevent infection, illness and other adverse effects. Certain reclaimed water 44 may not be potable but may be usable within appliances 62 within a structure 12. Such reclaimed water 44 may be useful in operating laundry appliances 62, dishwashers, and other similar appliances 62 that may include a separate sanitizing function that helps to remove various microbes that may be present within the reclaimed water 44.

As exemplified in FIGS. 2-6, the reclamation chamber 38 stores reclaimed water 44 for reuse within the structure 12, as described above. In order to deliver this reclaimed water 44 to portions of the structure 12, a pump 42 can be installed within or near a portion of the reclamation chamber 38. This pump 42 can be in communication with a valve assembly 120 that can be selectively activated for delivering the reclaimed water 44 to various portions of the structure 12. The valve assembly 120 can include a primary valve 122 that can operate to selectively combine the reclaimed water 44 with a primary water supply 124.

In certain aspects of the device, the amount of reclaimed water 44 stored within the reclamation chamber 38 may be insufficient for operating, by itself, various appliances 62 or other components within the structure 12. In order to supplement the amount of water delivered to these appliances 62, the use of primary water supply 124 is added to the reclaimed water 44 for providing sufficient water to these appliances 62. The primary water supply 124 may be in the form of a water pump or well, a municipal water supply, other reclaimed sources, ground water, or other similar primary water supplies that can be used within various structures 12.

The primary valve 122 of the valve assembly 120 can be operated so that when water is desired within an appliance 62, the primary valve 122 opens to allow a certain percentage of water from the primary water supply 124 to mix with the reclaimed water 44 from the reclamation chamber 38. It is also contemplated that the primary valve 122 may be operated only when necessary, such as when the amount of reclaimed water 44 within the reclamation chamber 38 is substantially diminished and insufficient for use within an appliance 62 or for other uses. In this condition, the primary valve 122 can switch to allow for the use of water within the primary water supply 124 to be the only source provided to the appliance 62 or other use within the structure 12.

Referring again to FIGS. 2-6, the valve assembly 120 within the precipitation reclamation system 10 can include a backflow prevention mechanism 130. Such a backflow prevention mechanism 130 can be incorporated within the valve assembly 120 to prevent reclaimed water 44 from the reclamation chamber 38 from backflowing into the supply line for the primary water supply 124. Such a backflow prevention mechanism 130 is useful in preventing cross-contamination of the two water supplies. This is especially true where the reclaimed water 44 within the reclamation chamber 38 is not potable water, but is able to be used within certain appliances 62 within the structure 12. Where the reclaimed water 44 is not potable, such water may be referred to as "gray water" that may not be up to the sanitary standards of the primary water supply 124. Accordingly, cross-contamination of this "gray water" with the primary water supply 124 must be prevented. The backflow prevention mechanism 130 operates to prevent this cross-contamination. Contamination from the primary water supply 124 into the precipitation reclamation system 10 may not be problematic as the primary water supply 124 is typically maintained at a higher sanitary standard than the reclaimed water 44 within the reclamation chamber 38.

Referring again to FIGS. 5 and 6, in addition to the primary valve 122, the valve assembly 120 can include a secondary valve 140 that can selectively operate to add heated water 142 from the hot water supply 144 within the structure 12. In conditions where heated water 142 may be necessary, such as within an appliance 62, the secondary valve 140 can be used to add amounts of heated water 142 to the reclaimed water 44 moved by the pump 42 from the reclamation chamber 38. As with the primary valve 122, the secondary valve 140 also includes a backflow prevention mechanism 130 to prevent contamination from the "gray water" from the reclamation chamber 38 from being mixed into heated water 142 from the hot water source.

To provide temperature control for the reclaimed water 44 from the reclamation chamber 38, the supply line from the reclamation chamber 38, or the reclamation chamber 38 itself, can include various heating or cooling elements 150, 152 that can control the temperature of the reclaimed water 44 being moved throughout the structure 12. Such heating elements 150 can include electrical elements, flash-heating mechanisms, geothermal systems, and other similar mechanisms that may already be present within a structure 12. The cooling elements 152 can take the form of a refrigerant system, air conditioning system, geothermal system or other similar systems and mechanisms that can be used to cool fluids.

By way of example, and not limitation, the reclamation chamber 38 or a supply line from the reclamation chamber 38 may include integral temperature control mechanisms therein. Such temperature control mechanisms can include heaters, cooling mechanisms, and other similar mechanisms that can be incorporated within the reclamation chamber 38.

Referring now to FIGS. 1, 4 and 7-9, the reclamation chamber 38 may be installed within various appliances 62 or near various appliances 62 within a structure 12. As discussed above, the reclamation chamber 38 may be in the form of a pedestal 60 in this position below a washer 64, dryer 66 or both. Where the reclamation chamber 38 is installed within such a pedestal 60, the reclamation chamber 38 may be a separate container located within this pedestal 60. In one non-limiting example, the reclamation chamber 38 may be in the form of a flexible bag or container that can expand as it fills with runoff precipitation 14 from the downspout adapter 18. In such an embodiment, the flexible membrane can be biased toward an empty position such that the elasticity of the bag can assist the pump 42 in moving the reclaimed water 44 to other portions of the structure 12.

In various aspects of the device, the reclamation chamber 38 can be a substantially rigid chamber contained within a pedestal 60 or other similar enclosure. Where a rigid container is used as the reclamation chamber 38, various sensors, floats 86, and other sensing mechanisms can be utilized for assessing the amount of reclaimed water 44 within the reclamation chamber 38 at a particular time or over a certain time period. As discussed above, the amount of reclaimed water 44 within the reclamation chamber 38 can be used to activate or deactivate a regulating mechanism 82 that prevents or allows the flow of runoff precipitation 14 into the precipitation reclamation system 10.

Referring again to FIGS. 7-9, the enclosure that houses the reclamation chamber 38 may be in the form of a standalone enclosure 160 such as one that may be disposed between a washer 64 and dryer 66, as exemplified in FIG. 7. Additionally, the reclamation chamber 38 may be disposed within a kitchen or other cabinetry setting 162 where the reclamation chamber 38 is disposed within or hidden within a bank of cabinetry 164. Typically, a pedestal 60 or other enclosure that houses the reclamation chamber 38 may be accessed via a drawer, door, or other operable panel that may be manipulated for accessing the components of the reclamation chamber 38. Such components, as discussed above, can include a treatment mechanism, a valve assembly 120, a pump 42, and other similar mechanisms.

According to various aspects of the device, as exemplified in FIGS. 1-3, the fluid treatment mechanism 100 can be positioned upstream of the reclamation chamber 38. Where certain microbe treatment mechanisms 104 are included, the runoff precipitation 14 may be required to be located within a microbe treatment mechanism 104 for a certain amount of time in order to properly eliminate at least a portion of the microbe population contained therein. Accordingly, the fluid treatment mechanism 100 may include a separate holding tank that holds or sequesters the runoff precipitation 14 for a predetermined period of time to allow for the microbe treatment mechanism 104 to operate properly. Accordingly, a separate valve mechanism may be included at or near the fluid treatment mechanism 100 to regulate a flow of the runoff precipitation 14 into the fluid treatment mechanism 100 for treatment therein. Once treatment is complete, a separate valve assembly 120 may be activated to allow for the reclaimed water 44 to be moved into the reclamation chamber 38 for reuse.

It is also contemplated that the fluid treatment mechanism 100 can be an elongated series of pipes that may travel through various assemblies to be treated as it moves through this system of pipes within the fluid treatment mechanism 100. Additionally, the fluid treatment mechanism 100 may separate the flow of runoff precipitation 14 into a plurality of separate pipes to a portion of runoff precipitation 14 into smaller flows of the runoff precipitation 14 that are individually treated by separate systems before being moved to the reclamation chamber 38. The exact design of a fluid treatment mechanism 100 may depend upon the degree of filtration or sanitizing that is desired within the precipitation reclamation system 10.

According to various aspects of the device, the various pumps 42 and valve assemblies 120 included within the precipitation reclamation system 10 can be operated by a controller 170 that is in communication with each of these assemblies. During operation of the precipitation reclamation system 10, the controller 170 can monitor the current capacity of reclaimed water 44 within the reclamation chamber 38. Various sensors within the reclamation chamber 38 can communicate with the controller 170. Where the amount of reclaimed water 44 within the reclamation chamber 38 exceeds a certain value, the controller 170 can activate and deactivate a certain regulating mechanism 82 to prevent an additional flow of runoff precipitation 14 into the precipitation reclamation system 10. The controller 170 can also operate during use of the reclaimed water 44 where the pump 42 and valve assembly 120 are operated by the controller 170 to regulate an amount of the reclaimed water 44 that is moved by the pump 42 and through the valve assembly 120. In various embodiments, the controller 170 can operate the valve assembly 120 to regulate the primary and secondary valves 122, 140 for monitoring, regulating, and performing the addition of water from the primary water supply 124 or heated water 142 from the hot water supply 144.

The controller 170 can also operate and monitor the fluid treatment mechanism 100 by monitoring a flow of the runoff precipitation 14 through the fluid treatment mechanism 100 to ensure that the runoff precipitation 14 is treated for an appropriate period of time depending upon the configuration of the fluid treatment mechanism 100. Additionally, various water quality sensors 172 can be included within the precipitation reclamation system 10, where the water quality sensors 172 can be monitored by the controller 170. Where the water quality of the reclaimed water 44 falls below a certain level, the controller 170 can prevent the flow of reclaimed water 44 from the reclamation chamber 38 and into the structure 12. Alternatively, where the quality of reclaimed water 44 within the reclamation chamber 38 falls below a certain level, the controller 170 can reconfigure the valve assembly 120 to allow the reclaimed water 44 to flow to only certain portions of the structure 12.

By way of example, and not limitation, where the reclaimed water 44 has a certain sanitation level that allows for use within various appliances 62, toilets, and other gray water uses, a change in the water quality to below a certain sanitation level may trigger a reconfiguration of the valve assembly 120 to allow for the reclaimed water 44 to be used only for toilets. It is also contemplated that various water quality sensors 172 can be included upstream of the fluid treatment mechanism 100. Where the runoff precipitation 14 includes certain impurities that may be particularly hazardous or noxious or may not be able to be fully treated by the fluid treatment mechanism 100, the controller 170 can sense this particular contaminant and alert the user as to this particular contaminant. Additionally, the controller 170 may temporarily suspend one or more portions of the precipitation reclamation system 10 until such time as the contaminant can be addressed.

According to various aspects of the device, the valve assembly 120 may typically include solenoid valves, although other types of valves may be incorporated upon a particular design of the precipitation reclamation system 10. Additionally, the reclamation chamber 38 may include a single pump 42 for moving a single flow of the reclaimed water 44 to the valve assembly 120. It is also contemplated that multiple pumps 42 can be included within the reclamation chamber 38 for moving separate flows of reclaimed water 44 to different portions of the structure 12 or to different valve assemblies 120 having different design needs or tolerances.

By way of example, and not limitation, the reclamation chamber 38 may include a first pump 42 that delivers reclaimed rainwater to a valve assembly 120 having both the primary and secondary valves 122, 140 where water from a primary water supply 124 and heated water 142 from a water heater may both be useful in providing reclaimed water 44 to a particular portion of the structure 12. The same reclamation chamber 38 may include a second pump 42 that delivers a second flow of reclaimed water 44 to a second valve assembly 120 that may include only the primary valve 122 where no heated water 142 is needed within this portion of the structure 12.

According to various aspects of the device, the water level sensor 174 included within the reclamation chamber 38 can include a sensor that can give continuous water level measurement or discreet indication of "yes" or "no" to determine whether a predetermined level of reclaimed water 44 has been achieved. In certain embodiments, a capacitive sensor can provide a discreet signal, and a pressure differential sensor can provide continuous information. In certain embodiments, each of these methods or sensors can be operated to provide finite information concerning the pressure within the system as well as the amount of reclaimed water 44 within the reclamation chamber 38. Additionally, various floats 86 or other similar sensors may also be used as the water level sensor 174 within the reclamation chamber 38.

As exemplified in FIGS. 1, 2 and 10-16, the downspout adapter 18 used in connection with the precipitation reclamation system 10 is configured to be positioned within a dryer vent housing 36, as a dryer vent adapter 20. The dryer vent housing 36 is typically a vent that is positioned within an exterior wall of the structure 12 and through which a dryer vent 70 is positioned for expressing heated air 180 and typically heated and humid air from the dryer 66 to an exterior 22 of the structure 12. The dryer vent housing 36 can include various louvers 182 or other mechanisms that prevent birds and other wildlife from entering into the dryer vent housing 36. The dryer vent housing 36 is typically in communication with the laundry dryer 66.

As exemplified in FIGS. 11-16, the downspout adapter 18, or dryer vent adapter 20, can include a body 184 that fits within the dryer vent housing 36. Typically, the body 184 of the dryer vent adapter 20 will be sized such that it will fit within a standard dryer vent housing 36, such that a retrofit configuration is available. The sizing of the dryer vent adapter 20 is also configured to fit within current standards for dryer vent housings 36 that are used in the current construction methods and techniques. The body 184 of the dryer vent adapter 20 also includes an inner aperture 186 that extends around and supports a dryer vent 70 that is positioned within the dryer vent housing 36. Accordingly, the dryer vent adapter 20 fits within the dryer vent housing 36 and includes an inner aperture 186 that supports the positioning of the dryer vent 70 within the dryer vent housing 36. The dryer vent adapter 20 can also include an inlet 188 and an outlet 190 that are connected to the body 184 of the dryer vent adapter 20.

Figure 11:
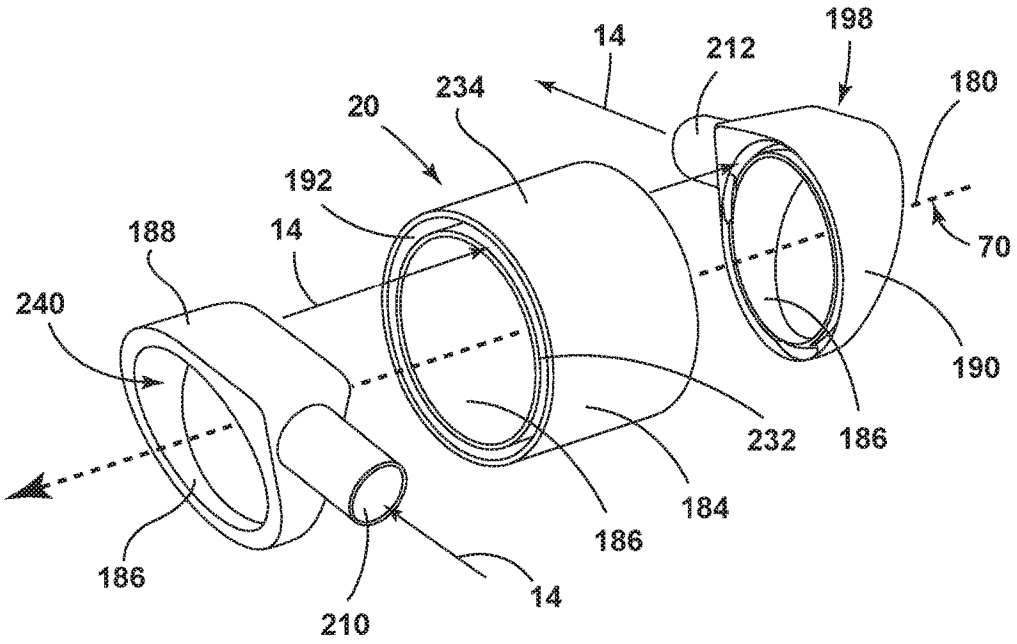
FIG. 11 is an exploded perspective view of an aspect of the dryer vent adapter.
Figure 12:
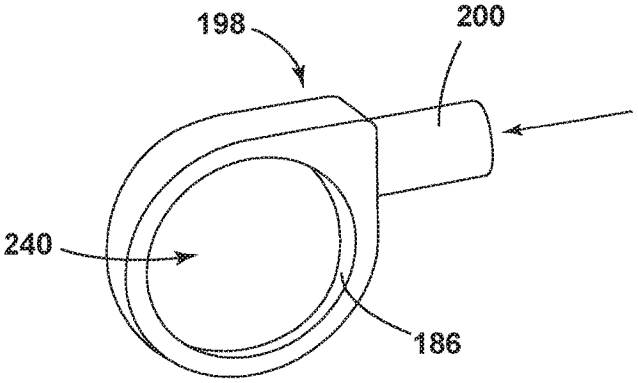
FIG. 12 is a front perspective view of an inlet/outlet used within the dryer vent adapter.
Figure 13:
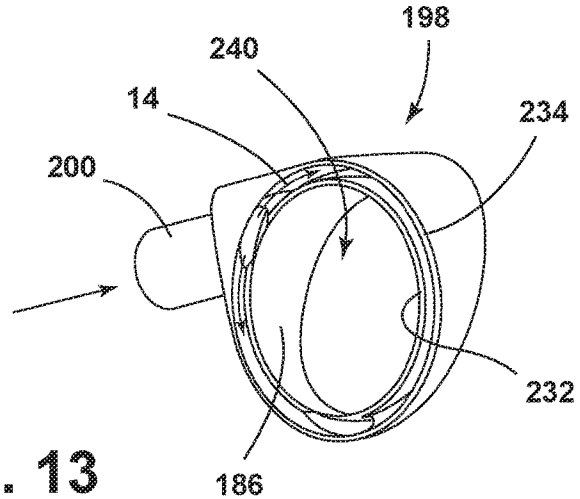
FIG. 13 is a rear perspective view of an inlet/outlet for the dryer vent adapter.

As exemplified in FIGS. 11-13, the inlet 188, outlet 190 and the body 184 can be separate portions that are adhered or otherwise welded together. In this manner, the inner aperture 186 of the dryer vent adapter 20 or downspout adapter 18 is also defined within each of the inlet 188 and the outlet 190. Accordingly, the inlet 188, the body 184 and the outlet 190 of the dryer vent adapter 20 cooperatively define an interior path 192 through which runoff precipitation 14 from the precipitation downspout 32 is directed to the interior fluid conduit of the precipitation reclamation system 10. In this manner, each of the inlet 188, the body 184 and the outlet 190 includes a portion of the interior path 192 that allows for the movement of the runoff precipitation 14 therethrough.

In addition to providing for the flow of runoff precipitation 14 through the interior path 192, the dryer vent adapter 20 is also configured to be in thermal communication with the dryer-air outlet 190 or the dryer vent 70. In this manner, during cold or inclement weather, when runoff precipitation 14 may tend to freeze within portions of the gutter system for the structure 12, heat emanating from the dryer vent 70 that emanates from the dryer 66 may serve to heat the dryer vent adapter 20 to allow for movement of runoff precipitation 14 therethrough and into the structure 12 for collection within the reclamation chamber 38.

Referring again to FIGS. 11-13, the inlet 188 and outlet 190 may be identical pieces that each include a port 200 that extends from a portion of the inlet 188 or outlet 190. In this manner, the inlet 188 or outlet 190 can be defined by a single end adapter 198 that is attached to either end of the body 184 for the dryer vent adapter 20. The end adapter 198 can include the port 200 that can define either of the inlet port 210 or the outlet port 212 depending upon the placement of the end adapter 198 relative to the body 184 and placement of the dryer vent adapter 20 relative to the dryer vent housing 36. By using the end adapter 198 that can be used as the inlet 188 or outlet 190, the amount of tooling needed for producing the dryer vent adapter 20 can be minimized such that only two components are needed.

According to various aspects of the device, the body 184 may be incorporated within portions of the end adapter 198 such that only two end adapters 198 can be connected together to form the entire dryer vent adapter 20. In such an embodiment, the interior path 192 can be defined within the two end adapters 198 that are connected together.

Referring again to FIG. 10, in various aspects of the device, the inlet port 210 can be positioned toward a top portion 220 of the dryer vent adapter 20 and the outlet port 212 may be positioned near a bottom portion 222 of the dryer vent adapter 20. In this manner, the flow of runoff precipitation 14 can be generally according to the flow of gravity through the interior path 192 of the dryer vent adapter 20.

Figure 15:
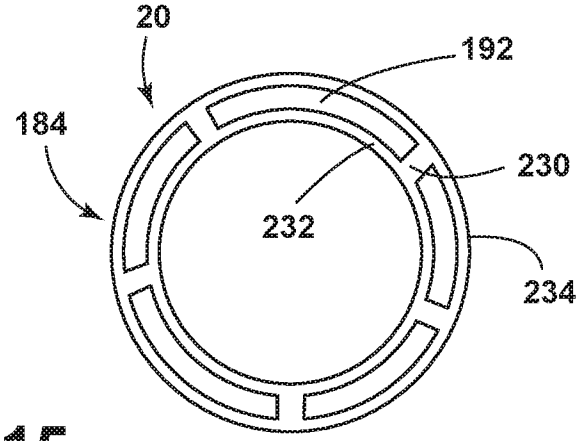
FIG. 15 is a cross-sectional view of an alternative aspect of a body portion for a dryer vent adapter.
Figure 16:
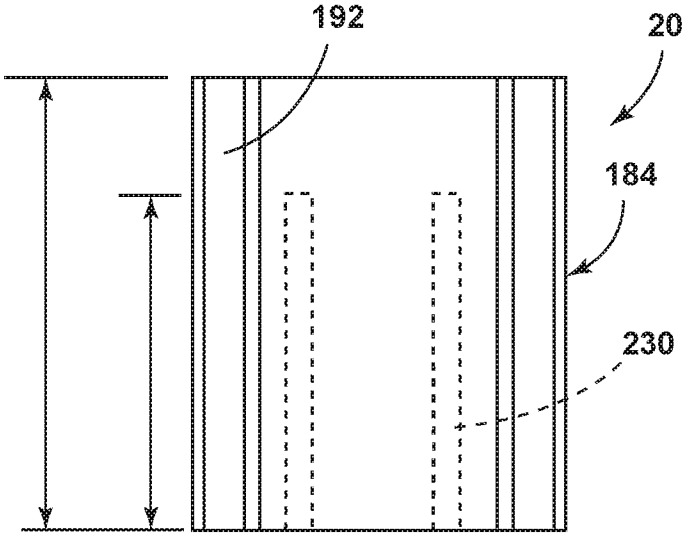
FIG. 16 is a cross-sectional view of an aspect of a body portion for a dryer vent adapter that includes internal ribs.
Figure 14:
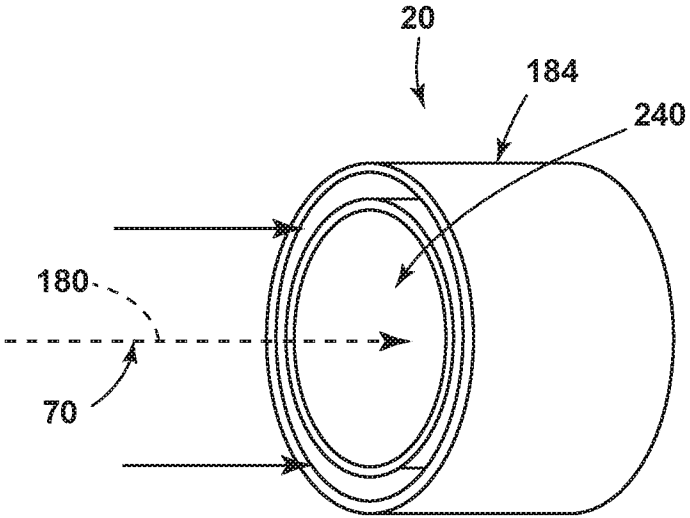
FIG. 14 is a perspective view of a body portion for the dryer vent adapter.
Figure 17:
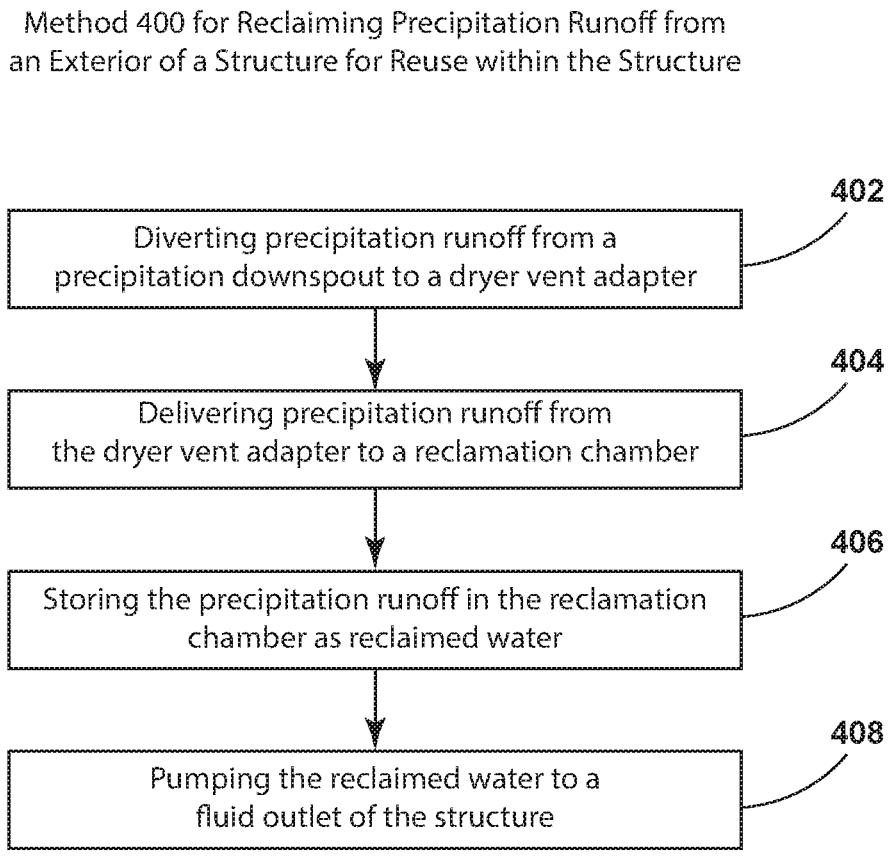
FIG. 17 is a schematic flow diagram illustrating a method for reclaiming runoff precipitation from an exterior of a structure for use within the structure.

According to various aspects of the device, as exemplified in FIGS. 15 and 16, the body 184 and portions of the end adapter 198 can each include interior ribs 230 or internal structures 12 that support the spacing of the inner layer 232 and outer layer 234 of the body 184. These ribs 230 may not extend the entire length of the body 184 so that a flow of fluid through the body 184 may not be impeded as the runoff precipitation 14 moves through the interior path 192. Accordingly, certain cross sections of the body 184 may include the internal ribs 230, where other cross sections of the body 184, typically near the ends of the body 184, may define a substantially continuous interior path 192 through the body 184 of the dryer vent adapter 20. By including the structural ribs 230, the body 184 can be formed as a separate piece having the inner layer 232 and an outer layer 234 that cooperate to form the interior path 192 through which the runoff precipitation 14 can be directed.

Referring again to FIGS. 1 and 10, the dryer vent adapter 20 can be disposed within a dryer vent housing 36 such that the dryer vent adapter 20 forms a retaining structure 240 that holds the dryer vent 70 or dryer-air outlet 190 that is run from the drying appliance 62 and to the dryer vent housing 36. According to various aspects of the device, the dryer vent adapter 20 can be integrally formed within the dryer vent housing 36, such that the dryer vent housing 36 can be made as a separate piece that is installed within an outer wall of the structure 12. The use of the integrally formed dryer vent housing 36 having the dryer vent adapter 20 or, alternatively, the dryer vent adapter 20 that can be installed separately within an existing dryer vent housing 36, can depend upon whether the dryer vent adapter 20 is being installed within new construction or retrofitted within an existing structure 12. The use of the dryer vent adapter 20 is meant to provide a substantially water-tight interface between the exterior areas of the structure 12 and the interior of the structure 12 so that runoff precipitation 14 that moves through the dryer vent housing 36 does not leak or significantly leak within the wall of the structure 12 or within interior areas of the structure 12.

The various components of the dryer vent adapter 20 that include the inlet 188, outlet 190 and the body 184 can be welded together so that it forms a substantially water-tight assembly. In this manner, the dryer vent adapter 20 can connect with a downspout 32 of a structure 12 or other portion of a gutter system for the structure 12. The outlet 190 of the dryer vent adapter 20 can then be connected with the interior fluid conduit and onto the reclamation chamber 38. Various fittings that are attached to the dryer vent adapter 20 will be flexible to account for differences in the temperature throughout the year. These different temperatures experienced by the dryer vent adapter 20 and other portions of the precipitation reclamation system 10 may experience expansion and contraction throughout the course of the year as a result of changes in temperature. Various flexible fittings can be used to account for these changes in temperature so that leaks do not result from these expansions and contractions over time.

Referring now to FIGS. 1-17, having described various aspects of the precipitation reclamation system 10 and the dryer vent adapter 20, a method 400 is disclosed for reclaiming runoff precipitation 14 from an exterior 22 of a structure 12 and for reuse within the structure 12. According to the method 400, runoff precipitation 14 is diverted from a precipitation downspout 32 and/or gutter 30 and into a dryer vent adapter 20 (step 402). As discussed above, the dryer vent adapter 20 is typically positioned within the dryer vent housing 36 that is located within a wall of the structure 12.

The dryer vent adapter 20 includes the aperture to allow for placement of the dryer-air duct therein. In this manner, the dryer vent adapter 20 serves to secure the dryer vent 70 or dryer-air duct within the dryer vent housing 36.

According to the method 400, runoff precipitation 14 is then delivered from the dryer vent adapter 20 and to a reclamation chamber 38 via a dryer vent housing 36 (step 404). As discussed above, the dryer vent housing 36 receives the dryer vent adapter 20 and a reclamation conduit 46 extends between the dryer vent adapter 20 and the reclamation chamber 38. The runoff precipitation 14 is then stored within the reclamation chamber 38 (step 406). The reclamation chamber 38 is typically positioned proximate or within an appliance housing 40 to define reclaimed water 44 therein. The reclamation conduit 46 runs from the dryer vent adapter 20 and to the reclamation chamber 38.

As part of the method 400, the step 404 of delivering the runoff precipitation 14 can include filtering particulate material from the runoff precipitation 14 and also moving microbes from the runoff precipitation 14 to define reclaimed water 44 that is stored within the reclamation chamber 38. According to the method 400, the reclaimed water 44 is then pumped from the reclamation chamber 38 into a fluid outlet 250 of the structure 12 (step 408). The fluid outlet 250 of the structure 12 can be in the form of a toilet, an appliance 62, utility faucet or other non-drinking source. Where the fluid treatment mechanism 100 of the precipitation reclamation system 10 includes a sufficient filtration mechanism to produce potable water, the reclaimed water 44 can also be used as drinking water within the structure 12.

According to the method 400, the step 408 of pumping the reclaimed water 44 can include combining the reclaimed water 44 with a primary water source via a valve assembly 120.

Using the precipitation reclamation system 10 described herein, rainwater and other precipitation can be harvested, stored and reused within a particular structure 12. In more dense residential areas where municipal water systems are used, the use of reclaimed water 44 from the precipitation reclamation system 10 can save money in the cost of using the municipal water system. Also, in less populated areas, more arid climates, the use of the precipitation reclamation system 10 can conserve water that may intermittently fall during a rainy season. The use of the precipitation reclamation system 10 can conserve large amounts of water over the course of a year.

It is contemplated that the size of the reclamation chamber 38 used in connection with the precipitation reclamation system 10 can vary depending upon the means of the particular structure 12. Larger residential structures 12 having significant roof 34 and surface area may require larger reclamation chambers 38. Conversely, smaller areas may require a smaller reclamation chamber 38. The size of the reclamation chamber 38 may also depend on the degree of usage of the reclaimed water 44 within the structure 12.

Additionally, the use of the dryer vent adapter 20 or the downspout adapter 18 is configured to provide for reclamation of the runoff precipitation 14 without adding additional apertures that may be formed within the structure 12. Typical residential structures 12 already include dryer vent housings 36 that allow for venting of dryer air from the drying appliance 62. Utilizing this existing aperture within a building envelope 24, the use of the dryer vent adapter 20 can reclaim runoff precipitation 14 without adding additional holes, openings or other punctures within a building envelope 24. Various flashing techniques can be used in connection with the dryer vent adapter 20 to minimize or substantially prevent the infiltration of precipitation into the dryer vent housing 36. Additionally, where runoff precipitation 14 may enter into the dryer vent housing 36, existing dryer vent housings 36 are manufactured such that these fixtures include water directing channels that direct runoff away from the structure 12 and to an exterior portion of the building.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A precipitation reclamation system comprising:

a downspout adapter configured to receive runoff precipitation from a precipitation channel for a structure, wherein the downspout adapter is configured to attach to the structure at a vent that places an interior of the structure in communication with an area external to the structure;

a reclamation chamber that is disposed within an appliance housing, the reclamation chamber having a pump; and a reclamation conduit that extends from the downspout adapter to the reclamation chamber and configured to direct the precipitation runoff to the reclamation chamber to define reclaimed water, wherein the pump is adapted to deliver the reclaimed water from the reclamation chamber to a portion of the structure for use.

2. The precipitation reclamation system of claim 1, wherein the appliance housing is a pedestal for at least one laundry appliance, wherein the at least one laundry appliance is positioned on top of the pedestal.

3. The precipitation reclamation system of claim 2, wherein the at least one laundry appliance includes a laundry washer and a laundry dryer, wherein the pedestal extends below each of the laundry washer and laundry dryer.

4. The precipitation reclamation system of claim 3, wherein the downspout adapter is configured to be positioned at a dryer vent housing in communication with the laundry dryer, wherein the downspout adapter includes a body that fits within the dryer vent housing and also includes an inner aperture that supports a dryer vent within the dryer vent housing.

5. The precipitation reclamation system of claim 4, wherein the downspout adapter includes an inlet and an outlet that are connected at the body of the downspout adapter.

6. The precipitation reclamation system of claim 5, wherein the inlet, the outlet and the body cooperate to define the inner aperture for supporting the dryer vent.

7. The precipitation reclamation system of claim 1, wherein the reclamation conduit includes a water treatment mechanism that includes at least a particulate filter.

8. The precipitation reclamation system of claim 7, wherein the water treatment mechanism includes a microbe treatment mechanism.

9. The precipitation reclamation system of claim 1, wherein the pump is in communication with a valve assembly, wherein the valve assembly includes a primary valve that operates to selectively combine the reclaimed water with a primary water supply.

10. The precipitation reclamation system of claim 9, wherein the valve assembly includes a secondary valve that selectively operates to combine heated water from a water heater with at least the reclaimed water.

11. A dryer vent adapter comprising:

an inlet that is configured for attachment to a precipitation downspout of a structure;

an outlet that is configured for attachment with an interior fluid conduit positioned within the structure; and a body that is configured for placement within a dryer vent housing, the body defining an inner aperture through which a dryer vent is to be received, wherein the body is configured to be positioned around the dryer vent and within the dryer vent housing.

12. The dryer vent adapter of claim 11, wherein the inner aperture is further defined by the inlet and the outlet.

13. The dryer vent adapter of claim 12, wherein the inlet, the body and the outlet cooperatively define an interior path through which runoff precipitation from the precipitation downspout is directed to the interior fluid conduit.

14. The dryer vent adapter of claim 13, wherein the inlet includes an inlet port that is positioned at a top portion of the inlet, wherein the inlet port is in communication with the interior path.

15. The dryer vent adapter of claim 13, wherein the outlet includes an outlet port that is positioned at a bottom portion of the outlet, wherein the outlet port is in communication with the interior path.

16. The dryer vent adapter of claim 11, wherein the inlet, the body and the outlet are each configured to be in thermal communication with the dryer vent.

17. The dryer vent adapter of claim 11, wherein the inlet and the outlet are welded to the body.

18. A method of reclaiming runoff precipitation from an exterior of a structure for reuse within the structure, comprising steps of:

diverting runoff precipitation from a precipitation downspout and into a dryer vent adapter;

delivering the runoff precipitation from the dryer vent adapter and to a reclamation chamber via a dryer vent housing that receives the dryer vent adapter and a reclamation conduit that extends between the dryer vent adapter and the reclamation chamber;

storing the runoff precipitation within the reclamation chamber at least partially positioned proximate an appliance housing to define reclaimed water, wherein the reclamation conduit runs from the dryer vent adapter to the reclamation chamber;

pumping the reclaimed water from the reclamation chamber to a fluid outlet of the structure.

19. The method of claim 18, wherein the step of delivering the runoff precipitation includes:

filtering particulate material from the runoff precipitation; and removing microbes from the runoff precipitation to define the reclaimed water.

20. The method of claim 18, wherein the step of pumping the reclaimed water includes:

combining the reclaimed water with a primary water supply via a valve assembly.

* * * * *